US007500566B2

(12) United States Patent
Smith et al.

(10) Patent No.: US 7,500,566 B2
(45) Date of Patent: Mar. 10, 2009

(54) MATERIAL SEPARATOR SYSTEMS

(75) Inventors: Roger G. Smith, Lake Oswego, OR (US); Jason D. Gerard, Fairview, OR (US)

(73) Assignee: Construction Equipment Company, Lake Grove, OR (US)

( * ) Notice: Subject to any disclaimer, the term of this patent is extended or adjusted under 35 U.S.C. 154(b) by 0 days.

(21) Appl. No.: 12/151,781

(22) Filed: May 8, 2008

(65) Prior Publication Data

US 2008/0217213 A1 Sep. 11, 2008

Related U.S. Application Data

(63) Continuation-in-part of application No. 11/985,211, filed on Nov. 13, 2007, which is a continuation-in-part of application No. 11/600,403, filed on Nov. 15, 2006.

(51) Int. Cl.
*B03B 5/00* (2006.01)

(52) U.S. Cl. ..... 209/173; 209/17; 210/522

(58) Field of Classification Search ..... 209/17, 209/172, 172.5, 173, 162, 155, 208; 210/521, 210/522, 538, 221.1; 241/20, 79.1; 239/505, 239/508–211, 513

See application file for complete search history.

(56) References Cited

U.S. PATENT DOCUMENTS 3,428,164 A * 2/1969 Lovegreen ..... 198/821
4,560,060 A 12/1985 Lenhart
4,750,995 A * 6/1988 Fogerson ..... 209/173
4,813,618 A 3/1989 Cullom
5,110,454 A * 5/1992 Parker et al. ..... 209/155
5,234,564 A 8/1993 Smith
5,421,147 A 6/1995 Holden et al.
5,992,642 A * 11/1999 Ota ..... 210/396
6,962,255 B2 11/2005 Tse
7,017,753 B2 * 3/2006 Tse ..... 209/162
7,223,059 B2 5/2007 Smith et al.
7,264,190 B2 9/2007 Smith et al.
7,273,150 B2 * 9/2007 Fridman et al. ..... 209/241
7,296,676 B2 11/2007 Smith et al.
7,314,140 B2 1/2008 Cullom et al.
2008/0060979 A1 3/2008 Cullom et al.

OTHER PUBLICATIONS

Flo-N-Go 20! Specification, 3 pages, http://www.flocait.com/fng-20.html, printed from Flo-Cait website on Aug. 31, 2006.

Office action, Jul. 23, 2008, 14 pages, U.S. Patent and Trademark Office.

Office action, Jul. 29, 2008, 13 pages, U.S. Patent and Trademark Office.

* cited by examiner

*Primary Examiner*—Patrick H Mackey
*Assistant Examiner*—Mark Hageman
(74) *Attorney, Agent, or Firm*—Kolisch Hartwell, P.C.

(57) ABSTRACT

A vehicle for separating a mixed debris stream is disclosed. The vehicle includes an elongate vehicle frame; a separating structure mounted on the vehicle frame and configured to contact the mixed debris stream with a fluid stream at a contact region to separate the mixed debris stream into at least a first debris stream and a second debris stream, wherein the second debris stream includes at least some material of a higher density than material from the first debris stream; a first conveyor; and a second conveyor, wherein the contact region is spaced from the feed end portion of the first conveyor, and wherein the separating structure is further configured to selectively direct the fluid stream to move the contact region among a plurality of locations relative to the feed end portion of the first conveyor.

18 Claims, 6 Drawing Sheets

MATERIAL SEPARATOR SYSTEMS

CROSS-REFERENCE TO RELATED APPLICATIONS

This application is a continuation-in-part of U.S. patent application Ser. No. 11/985,211, filed Nov. 13, 2007 and entitled "Material Separator Systems," which is a continuation-in-part of U.S. patent application Ser. No. 11/600,403, filed Nov. 15, 2006 and entitled "Material Separator System." The complete disclosures of the above applications are herein incorporated by reference for all purposes.

BACKGROUND OF THE DISCLOSURE

Various systems are used for processing dirt and/or debris mixtures, which may include rocks, concrete pieces, wood pieces, stones, discarded hardware, and other types of dirt and/or debris. That processing may include feeding and screening the dirt and/or debris mixtures into multiple piles. For example, one pile may contain essentially soil, and other piles may contain material of different sizes with at least some of those piles having commercial value as recycled product(s). Examples of systems for processing dirt and/or debris mixtures are illustrated in U.S. Pat. Nos. 5,234,608; 7,223,059; 7,264,190; and 7,296,676. The complete disclosures of those patents are herein incorporated by reference for all purposes.

Some debris mixtures may contain debris of different materials, such as wood pieces and rock. Those debris mixtures need to be separated from each other to have commercial value as recycled product(s) and/or for further processing. Various equipment may be used that separate the debris mixtures into separate piles, such as a pile primarily composed of wood pieces and another pile primarily composed of rock.

SUMMARY OF THE DISCLOSURE

Some embodiments provide a vehicle for separating a mixed debris stream. In some embodiments, the vehicle may include an elongate vehicle frame; a separating structure mounted on the vehicle frame and configured to contact the mixed debris stream with a fluid stream at a contact region to separate the mixed debris stream into at least a first debris stream and a second debris stream, wherein the second debris stream includes at least some material of a higher density than material from the first debris stream; a first conveyor having a feed end portion positioned to receive the first debris stream from the separating structure, and a discharge end portion spaced from the feed end portion of the first conveyor; and a second conveyor having a feed end portion positioned to receive the second debris stream from the separating structure, and a discharge end portion spaced from the feed end portion of the second conveyor, wherein the contact region is spaced from the feed end portion of the first conveyor, and wherein the separating structure is further configured to selectively direct the fluid stream to move the contact region among a plurality of locations relative to the feed end portion of the first conveyor.

In some embodiments, the vehicle may include an elongate vehicle frame; a separating structure mounted on the vehicle frame and configured to contact the mixed debris stream with a fluid stream to separate the mixed debris stream into at least a first debris stream and a second debris stream, the second debris stream including at least some material of a higher density than material from the first debris stream, wherein the separating structure includes a mixing area and a fluid ejection assembly, the fluid ejection assembly being configured to selectively direct the fluid stream entering the mixing area among a plurality of ejection angles relative a horizontal plane; a first conveyor having a feed end portion positioned to receive the first debris stream from the separating structure, and a discharge end portion spaced from the feed end portion; and a second conveyor having a feed end portion positioned to receive the second debris stream from the separating structure, and a discharge end portion spaced from the feed end portion.

Some embodiments provide a vehicle for separating a mixed debris stream that includes wood pieces and rock. In some embodiments, the vehicle may include an elongate vehicle frame; a separating structure mounted on the vehicle frame and configured to contact the mixed debris stream with a water stream at a contact region to separate the mixed debris stream into a wood debris stream that includes at least some water from the water stream and at least a substantial portion of the wood pieces from the mixed debris stream, and a rock debris stream that includes at least some water from the water stream and at least a substantial portion of the rock from the mixed debris stream; a wood conveyor having a feed end portion positioned to received the wood debris stream from the separating structure, and a discharge end portion spaced from the feed end portion of the wood conveyor; a rock conveyor having a feed end portion positioned to receive the rock debris stream from the separating structure, and a discharge end portion spaced from the feed end portion of the rock conveyor; and a water collection structure configured to receive water from the separating structure, the wood conveyor, and the rock conveyor, wherein the contact region is spaced from the feed end portion of the wood conveyor, and wherein the separating structure is further configured to selectively direct the water stream to move the contact region among a plurality of locations relative to the feed end portion of the wood conveyor.

DETAILED DESCRIPTION OF THE DISCLOSURE

Figure 1:
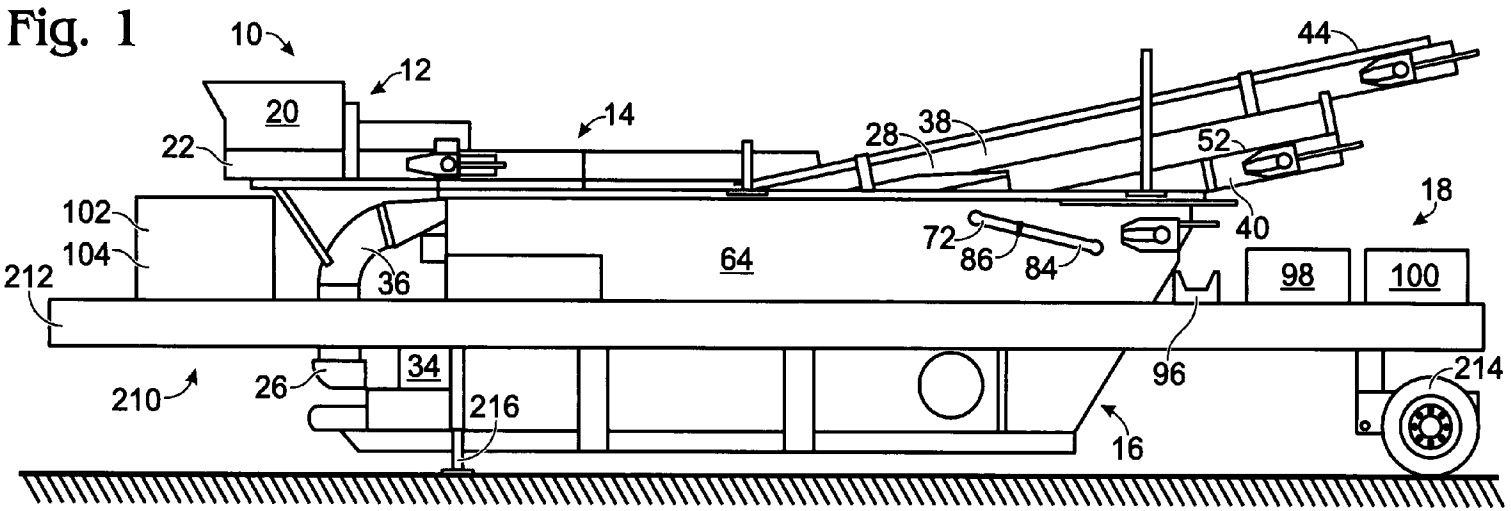
FIG. 1 is a side view of a material separator system mounted on a vehicle frame.

FIG. 1 depicts some embodiments of a material separator system 10. The material separator system may be supported by a vehicle 210. Vehicle 210 may include an elongate vehicle frame 212 and transport wheels 214, which may support the frame for movement over the ground. The vehicle also may include one or more lifting legs 216, which may selectively raise and/or lower material separator system 10 and/or vehicle frame 212. For example, the lifting legs may allow a collection tank of the material separator system to rest on the ground.

Although material separator system 10 is shown to be supported by a particular vehicle, the material separator system may be supported by any suitable structure configured to enable a user to relocate and/or move the material separator system to one or more desired locations. For example, material separator system 10 may be mounted on a vehicle with transport tracks. Additionally, although vehicle 210 is shown to include lifting legs 216, the vehicle may include any suitable structure configured to allow a user to selectively raise and/or lower the material separator system relative to the ground. For example, the vehicle may additionally, or alternatively, include one or more airbag axles that may support one or more of the transport wheels.

Figure 7:
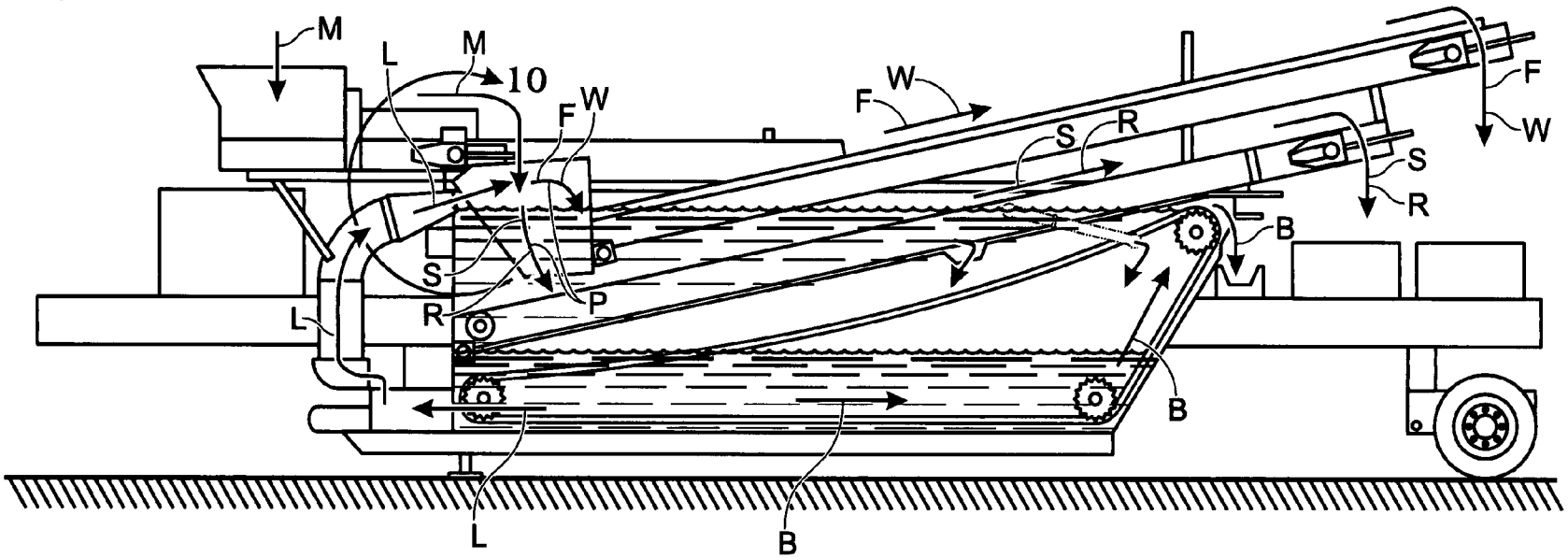
FIG. 7 is a side view of the material separator system of FIG. 1 shown without a side of a tank and a portion of the vehicle frame to show an illustrative example of the flow of various streams when the material separator system is in operation.

Material separator system 10 may include any suitable structure configured to receive a mixed debris stream M and to at least partially separate that stream into a plurality of debris streams P, such as a first debris stream F and a second debris stream S, as shown in FIG. 7. Material or debris in the debris streams may differ in density, weight, size, length, width, thickness, and/or any suitable properties and/or characteristics. For example, the second debris stream may include at least some material of a higher density than material from the first debris stream.

An illustrative example of a mixed debris stream M may include wood pieces and rock. When the mixed debris stream includes those components, then the material separator system may be configured to separate that stream into at least a wood debris stream W and a rock debris stream R. The wood debris stream may include at least a substantial portion of the wood pieces from mixed debris stream M. Additionally, or alternatively, the rock debris stream may include at least a substantial portion of the rock from mixed debris stream M.

Although the mixed debris stream is discussed to include wood pieces and rock, the mixed debris stream may alternatively, or additionally, include other components such as fibrous material, dirt, gravel, etc. Additionally, although material separator system 10 is discussed to separate mixed debris stream M into wood debris stream W and rock debris stream R, the material separator system may additionally, or alternatively, be configured to separate the mixed debris stream into other suitable streams.

Moreover, although material separator system 10 is discussed to separate mixed debris stream M into two debris streams, the material separator system may be configured to separate the mixed debris stream into three or more streams. Furthermore, although material separator system 10 is discussed to separate mixed debris stream M into plurality of streams P, the material separator system may separate only one or more portions of the mixed debris stream into the plurality of streams. Additionally, although material separator system 10 is discussed to receive a mixed debris stream, the material separator system may receive two or more debris streams, each of those streams may be mixed and/or at least substantially include one or more types of debris.

Figure 2:
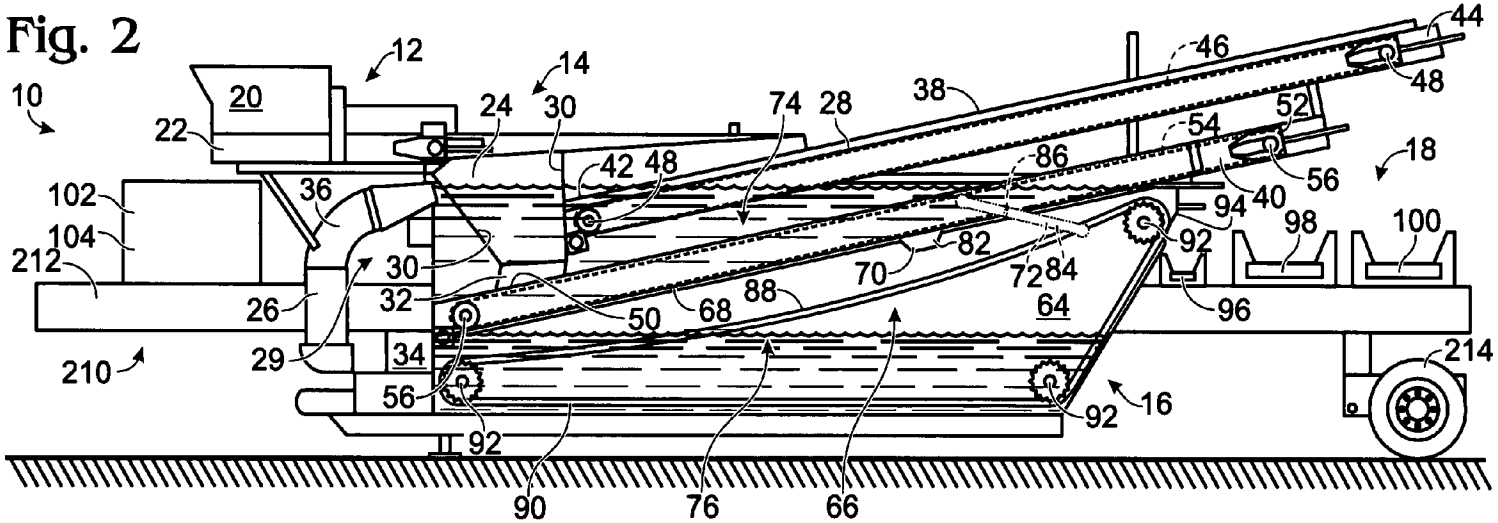
FIG. 2 is a side view of the material separator system of FIG. 1 shown without a side of a tank and a portion of the vehicle frame to show internal components of the material separator system.

An illustrative example of material separator system 10 may include a feed structure 12, a separating structure 14, a fluid collection structure 16, and a conveying structure 18, as shown in FIGS. 1-2. Feed structure 12 may include any suitable structure configured to feed a mixed debris stream to a mixing tank of the separating structure. For example, feed structure 12 may include a feed hopper 20 and a feed conveyor 22, as shown in FIG. 1.

The feed hopper may be configured to receive mixed debris stream M from any suitable source(s), such as one or more material processing systems. Feed conveyor 22 may be configured to receive mixed debris stream M from the feed hopper and to transport the mixed debris stream to separating structure 14. Although feed structure 12 is shown to include feed hopper 20 and feed conveyor 22, the feed structure may include any suitable structure configured to feed mixed debris stream M to the separating structure.

Separating structure 14 may be mounted on, supported by, or operatively connected to the vehicle frame. The separating structure may include any suitable structure configured to separate mixed debris stream M into at least first debris stream F and second debris stream S. For example, separating structure 14 may include a mixing area or mixing tank 24, a fluid ejection assembly 26, and a conveying assembly 28, as shown in FIG. 2. The mixing tank and the fluid ejection assembly also may be referred to as a separating assembly 29.

Mixing tank 24 may include any suitable structure configured to contact mixed debris stream M with one or more fluid streams L from fluid ejection assembly 26 to separate the mixed debris stream to at least first debris stream F and second debris stream S. For example, mixing tank 24 may include one or more walls 30 and one or more skirts 32, which may at least partially contain the mixed debris stream and the fluid streams. In some embodiments, mixing tank 24 may be an area within and/or be in fluid communication with an upper portion of a collection tank of the fluid collection structure.

In some embodiments, where the mixed debris stream M is contacted by the one or more fluid streams, at least some of the plurality of streams may include fluid from the fluid streams. For example, at least one of the first debris stream and the second debris stream may include at least some fluid from the fluid stream. Alternatively, the wood debris stream may include at least some fluid from the fluid stream and/or the rock debris stream may include at least some fluid from the fluid stream.

Fluid ejection assembly 26 may include any suitable structure configured to receive fluid from fluid collection structure 16 and to eject one or more fluid streams L to the mixing tank. The fluid streams may include any suitable fluid(s). For example, the fluid streams may at least substantially include water. When the fluid streams at least substantially include water, fluid ejection assembly 26 may be referred to as a water ejection assembly. The fluid ejection assembly may include a fluid pump 34 and a fluid pipe 36, as shown in FIG. 2. The fluid pump may move fluid from the fluid collection structure to the fluid pipe. Fluid pipe 36 may direct fluid from the fluid pump to eject one or more fluid streams L to mixing tank 24.

Although fluid ejection assembly 26 is shown to include a single pump and a single pipe, the fluid ejection assembly may include two or more pumps and/or two or more pipes. Additionally, although fluid ejection assembly 26 is shown to receive fluid from the fluid collection structure, the fluid ejection assembly may alternatively, or additionally, receive fluid from any suitable source(s). Moreover, although fluid ejection assembly 26 is shown to include fluid pump 34 and fluid pipe 36, the fluid ejection assembly may include any suitable structure to receive fluid from fluid collection structure 16 and to eject one or more fluid streams L to the mixing tank.

Figure 10:
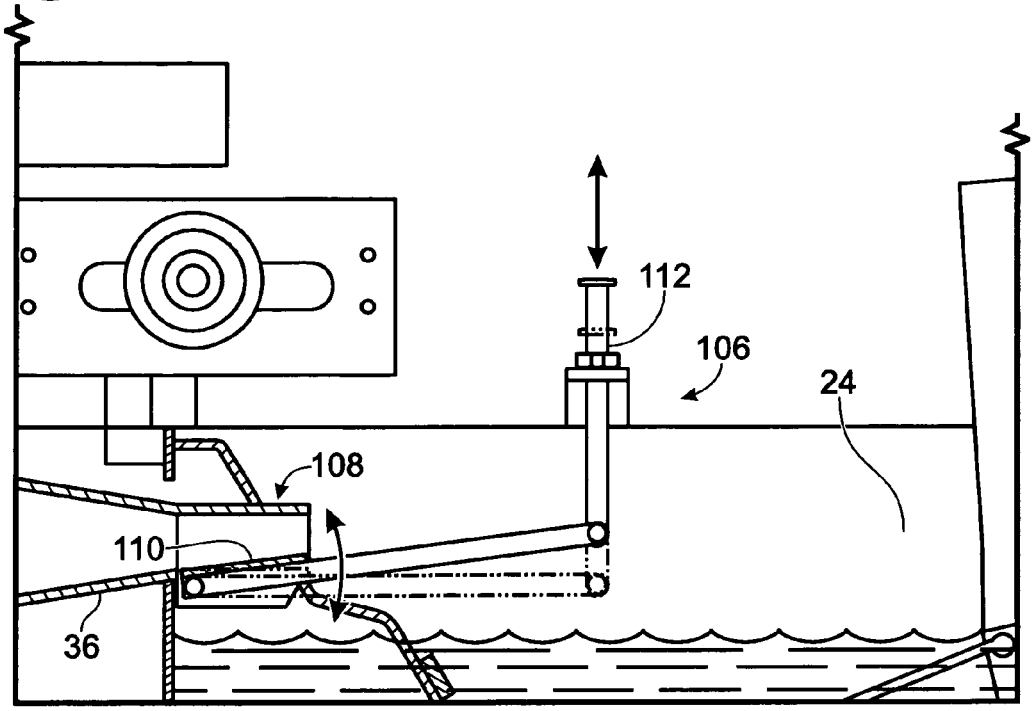
FIG. 10 is a partial view of the material separator system of FIG. 1 shown without a side of a tank to show components of a separating structure of the material separator system.
Figure 11:
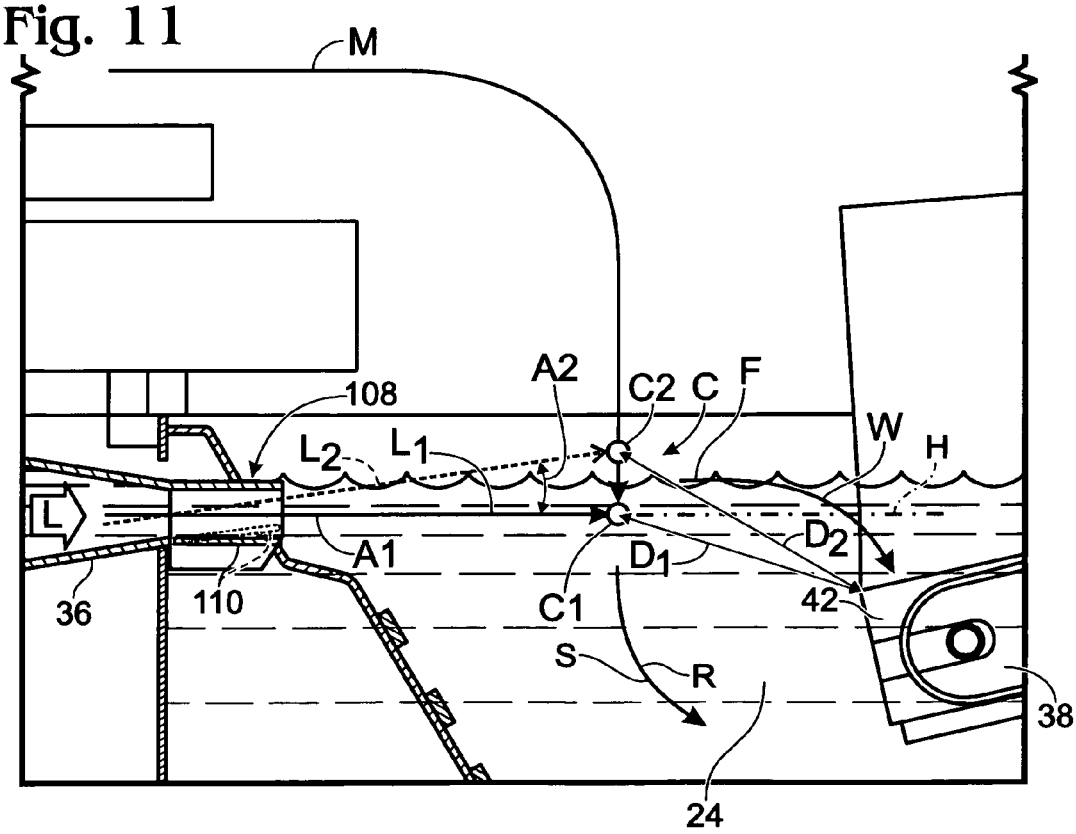
FIG. 11 is a partial view of the material separator system of FIG. 1 shown without a side of a tank and a control mechanism to show another illustrative example of the flow of various streams when the material separator system is in operation.

As shown in FIGS. 10-11, the fluid ejection assembly may include a fluid channeler 106 configured to selectively direct the one or more fluid streams entering mixing area 24 among a plurality of ejection angles relative to a suitable reference plane, such as a horizontal plane H. For example, fluid channeler 106 may include a flap 110 and a control mechanism 112. The flap may be mounted and/or movably connected on any suitable portion of the fluid ejection assembly, such as an end portion 108 of fluid pipe 36. For example, the flap may be pivotally connected to the end portion of the fluid pipe and may be configured to be selectively pivoted by the control mechanism to selectively direct the one or more fluid streams among a plurality of ejections angles, such as ejection angles A1 and A2.

In some embodiments, the one or more fluid streams may contact the mixed debris stream at a contact region C spaced from the feed end portion of the first conveyor. The fluid channeler may then be configured to selectively direct the one or more fluid streams to move the contact region among a plurality of locations relative to feed end portion 42 of first conveyor 38. For example, the fluid channeler may direct fluid stream L1 to contact the mixed debris stream at contact region C at a first location C1 (which may be adjacent to feed end portion 42 and/or at a first distance D1 from feed end portion 42), and/or direct fluid stream L2 to contact the mixed debris stream at contact region C at a second location C2 (which may be spaced from feed end portion 42 relative to the first location and/or at a second distance D2 from feed end portion 42. First distance D1 may be less than, equal to, or greater than second distance D2.

An ejection angle or a contact region location may be selected based, at least in part, on one or more properties of the fluid stream and/or mixed debris stream. For example, the contact region location selected may be based, at least in part, on a difference between an average density of material intended to be part of the first debris stream, and an average density of material intended to be part of the second debris stream. Based on that difference a larger (or smaller) ejection angle and/or contact region location farther from (or closer to) the feed end portion of the first conveyor may be required to ensure sufficient or adequate separation of material from the mixed debris stream.

Although fluid channeler 106 is shown to include flap 110 and control mechanism 112, the fluid channeler may include any suitable structure configured to selectively direct the one or more fluid streams entering the mixing area among a plurality of ejection angles and/or to selectively direct the one or more fluid streams to move the contact region among a plurality of locations relative to the feed end portion of the first conveyor. Additionally, although the plurality of ejections angles include ejection angle A1, which is shown to be zero or parallel to the horizontal plane, and ejection angle A2, which is shown to be positive or above the horizontal plane, the plurality of ejection angles may alternatively, or additionally, include any suitable angles, including ejection angles that are negative or below the horizontal plane.

Moreover, although separating structure 14 is shown to include fluid channeler 106, feed structure 12 may alternatively, or additionally, include a fluid channeler. For example, the fluid channeler of the feed structure may be configured to selectively direct the mixed debris stream entering the mixing area among a plurality of ejection angles relative to any suitable reference plane and/or to move a contact region among a plurality of locations.

Figure 4:
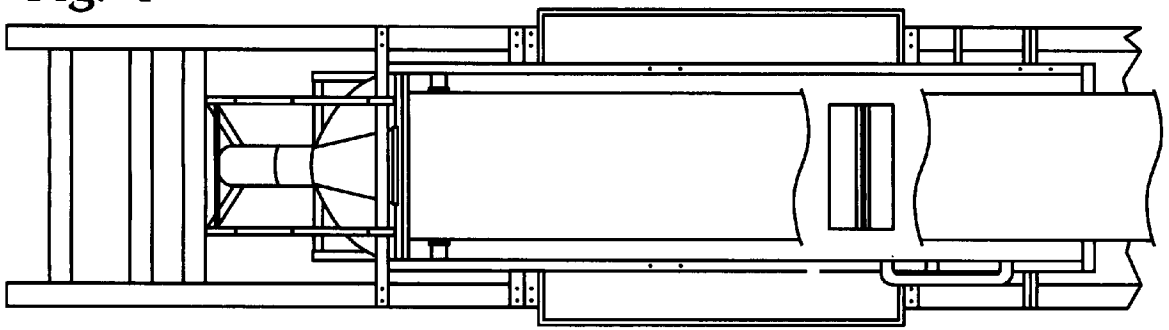
FIG. 4 is a fragmented top view of the material separator system of FIG. 1 shown without an upper conveyor to show a lower conveyor and a conduit below the lower conveyor.
Figure 3:
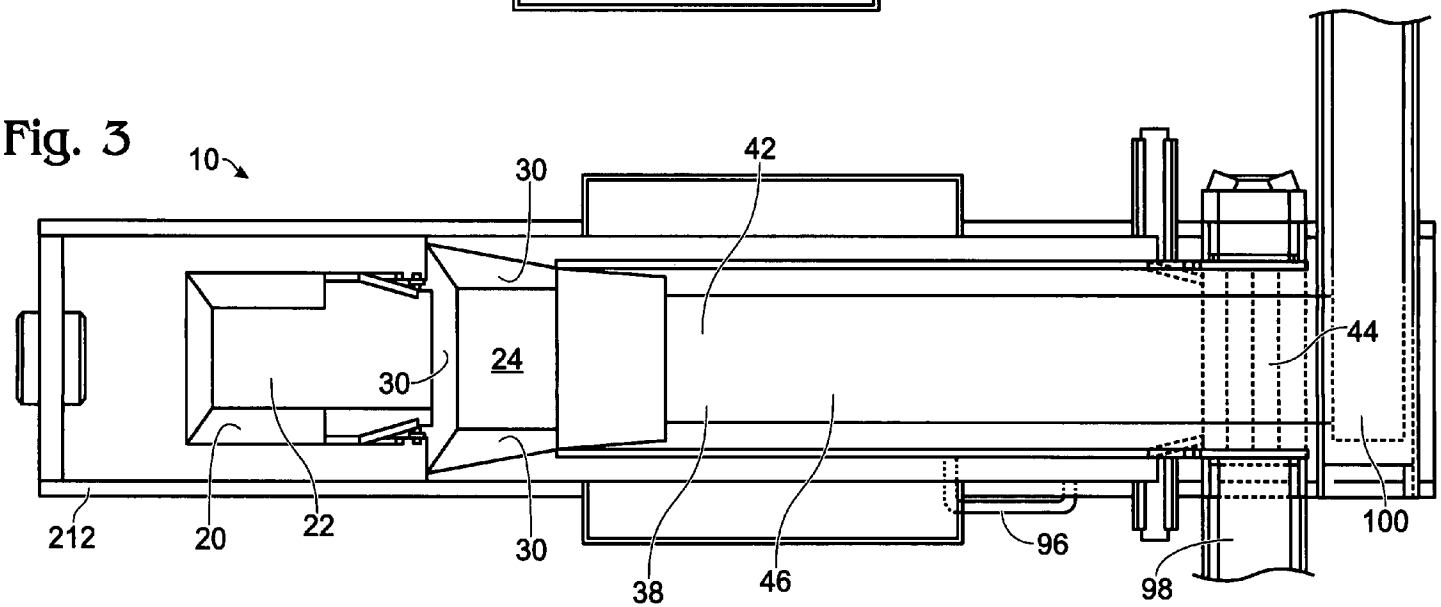
FIG. 3 is a top view of the material separator system of FIG. 1.
Figure 5:
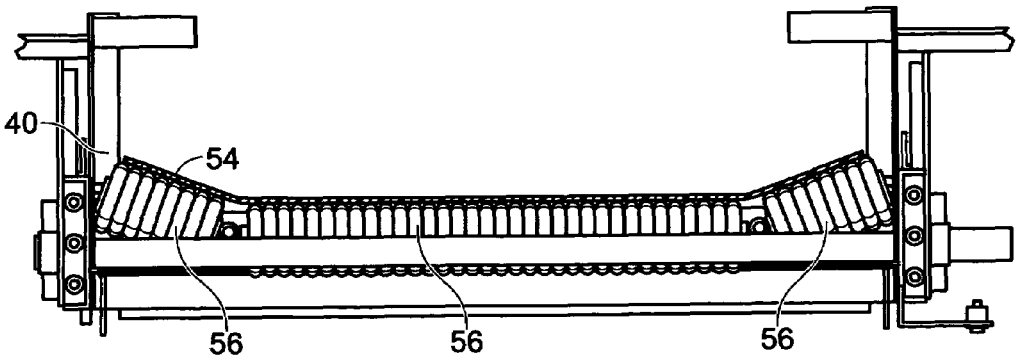
FIG. 5 is a sectional view of the lower conveyor taken along lines 5-5 in FIG. 4 of the material separator system of FIG. 1.

Conveying assembly 28 may include any suitable structure configured to transport at least the first and second debris streams away from the mixing tank. For example, the conveying assembly may include a first conveyor 38 and a second conveyor 40, as shown in FIGS. 2-4. The first conveyor may include a feed end portion 42 and a discharge end portion 44, and may be configured to transport the first debris stream (such as the wood debris stream) from the feed end portion to the discharge end portion. Feed end portion 42 may be disposed within or adjacent the mixing tank to receive the first debris stream and/or disposed within or adjacent an upper tank or upper portion of a collection tank of the fluid collection structure (discussed further below), and discharge end portion 44 may be spaced from the feed end portion, as shown in FIGS. 2-3. In some embodiments where the first debris stream includes the wood debris stream, the first conveyor may be referred to as a wood conveyor. Additionally, first conveyor 38 may include a first conveyor belt 46 and first conveyor rollers 48, as shown in FIGS. 2-3. The first conveyor rollers may be configured to move the first conveyor belt.

Second conveyor 40 may include a feed end portion 50 and a discharge end portion 52, and may be configured to transport the second debris stream (such as the rock debris stream) from feed end portion 50 to discharge end portion 52. Feed end portion 50 may be disposed within or adjacent the mixing tank and/or disposed within or adjacent an upper tank or upper portion of a collection tank of the fluid collection structure (discussed further below) to receive the second debris stream, and discharge end portion 52 may be spaced from feed end portion 50, as shown in FIGS. 2 and 4.

In some embodiments, where the second debris stream includes the rock debris stream, the second conveyor may be referred to as a rock conveyor. Additionally, second conveyor 40 may include a second conveyor belt 54 and second conveyor rollers 56, as shown in FIGS. 2 and 4. The second conveyor rollers may be configured to move the second conveyor belt.

First conveyor belt 46 and second conveyor belt 54 may include any suitable type(s) of belt and/or be made of any suitable material(s) configured to move one or more debris streams from the feed end portion to the discharge end portion of the belt(s), and/or to drain at least some fluid from at least one of the first debris stream and the second debris stream, such as to or toward the fluid collection structure (e.g., an upper tank or upper portion of a collection tank). For example, the first conveyor belt and/or the second conveyor belt may include a mesh conveyor belt.

"Mesh conveyor belt," as used herein, refers to a conveyor belt that includes an open structure made of a plurality of members with at least some of the members being overlapped and/or overlaid in a regular and/or irregular pattern. The mesh conveyor belt may include one or more layers of material(s), each of which includes at least a portion with an open structure made of a plurality of members with at least some of the members being overlapped and/or overlaid in a regular and/or irregular pattern. The mesh conveyor belt may be made of any suitable material(s), such as one or more plastic materials, one or more wire materials, and/or one or more rubber materials.

Alternatively, or additionally, the first and/or second conveyor belts may include a non-mesh conveyor belt. "Non-mesh conveyor belt," as used herein, refers to a conveyor belt that is not a mesh conveyor belt, as defined above. The non-mesh conveyor belt may include one or more layers with each layer made of any suitable material(s). When the non-mesh conveyor belt includes "n" number of layers, up to "n-1" of those layers may at least partially include an open structure made of a plurality of members with at least some of the members being overlapped and/or overlaid in a regular and/or irregular pattern. Additionally, the non-mesh conveyor belt may include any suitable top or top layer, such as a flat top, friction top, rib top, etc.

The non-mesh conveyor belt may be made of any suitable material(s). For example, the non-mesh conveyor belt may at least substantially be made of rubber and/or rubber material(s). The non-mesh conveyor belt may include one layer (or ply) or multiple layers (or plies). Additionally, the non-mesh conveyor belt, which is generally indicated at 55 in FIG. 6, may include a plurality of perforations and/or holes 58, and a plurality of retaining members 60. The plurality of perforations and/or holes may be configured to drain at least some fluid from at least one of the first debris stream and the second debris stream, such as to or toward the fluid collection structure. The holes may be any suitable size, such as ⅜ inches in diameter, and/or may be spaced any suitable distance, such as ¾ inches.

Figure 6:
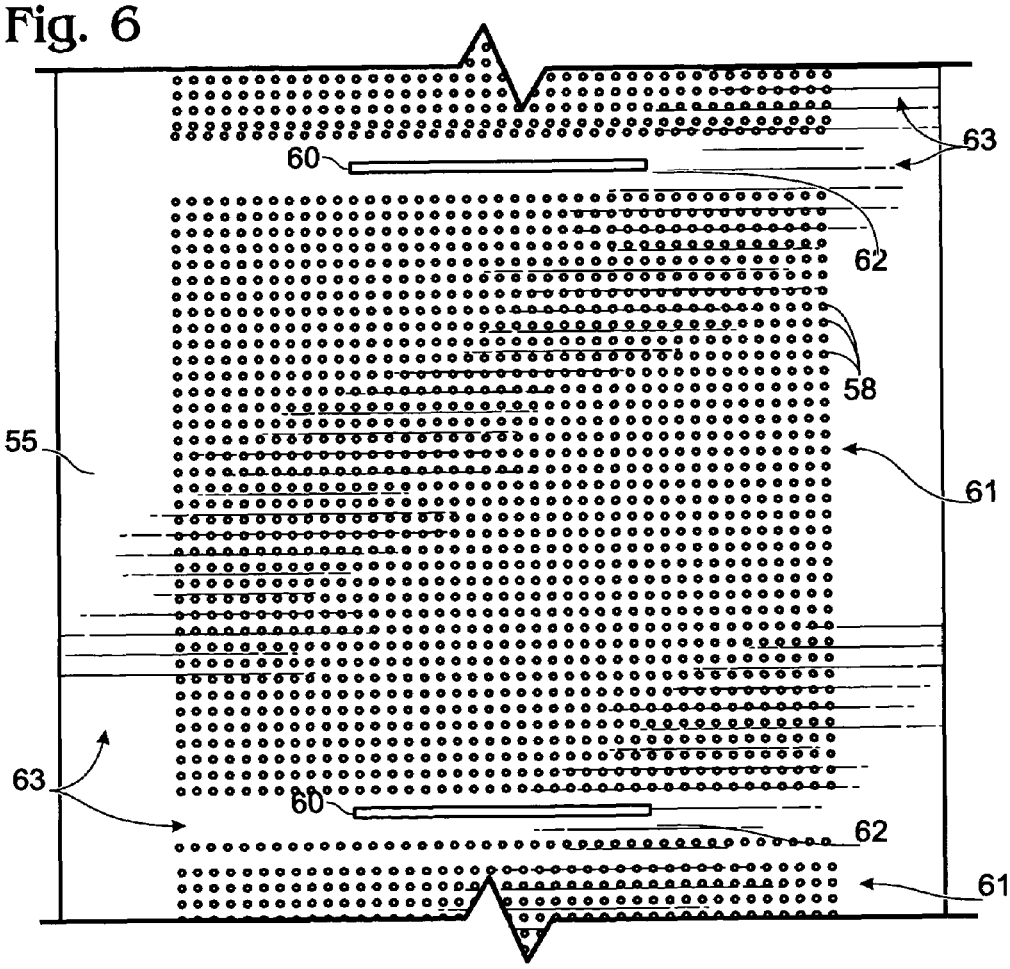
FIG. 6 is a fragmented top view of a conveyor belt of the upper and/or lower conveyor of the material separator system of FIG. 1.

Retaining members 60 may include any suitable structure configured to prevent at least some material of the debris stream from moving towards feed end portion 50. For example, the retaining members may include cleats 62, as shown in FIG. 6. The cleats may be any suitable dimensions and/or any suitable shape(s). For example, at least some of the cleats may be elongate. Alternatively, or additionally, at least some of the cleats may be chevron-shaped and/or any other suitable shapes.

The holes and/or retaining members may be positioned on the belt in any suitable manner. For example, the holes may be distributed across at least a substantial portion of the second conveyor belt, such as on one or more perforated portions 61 of the second conveyor belt. Alternatively, or additionally, at least some of the holes may be arranged in plural rows and at least some of the retaining members may be disposed between the plural rows on one or more solid portions 63 of the second conveyor belt.

Although holes 58 are shown to be distributed across a substantial portion of the non-mesh conveyor belt, the holes may be distributed across any suitable portion(s) of the non-mesh conveyor belt. Additionally, although the retaining members are shown to be positioned on solid portions 63 of the non-mesh conveyor belt, the retaining members may alternatively, or additionally, be disposed or positioned on any suitable location(s). For example, at least some of the retaining members may be positioned within the perforated portions of the non-mesh conveyor belt. Moreover, although holes 58 are shown to be arranged in plural rows, the holes may alternatively, or additionally, be arranged in any suitable way(s), such as staggered, regular, and/or irregular patterns.

Figure 8:
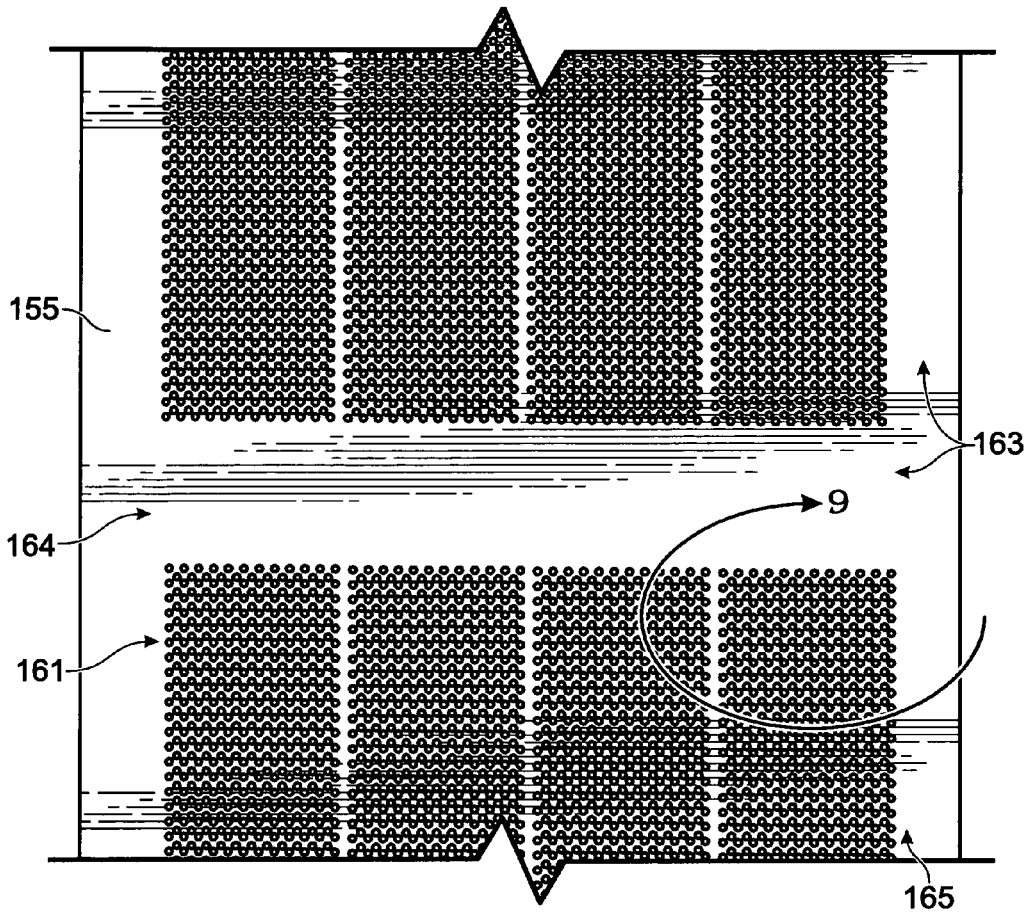
FIG. 8 is a fragmented top view of another example of a conveyor belt of the upper and/or lower conveyor of the material separator system of FIG. 1.
Figure 9:
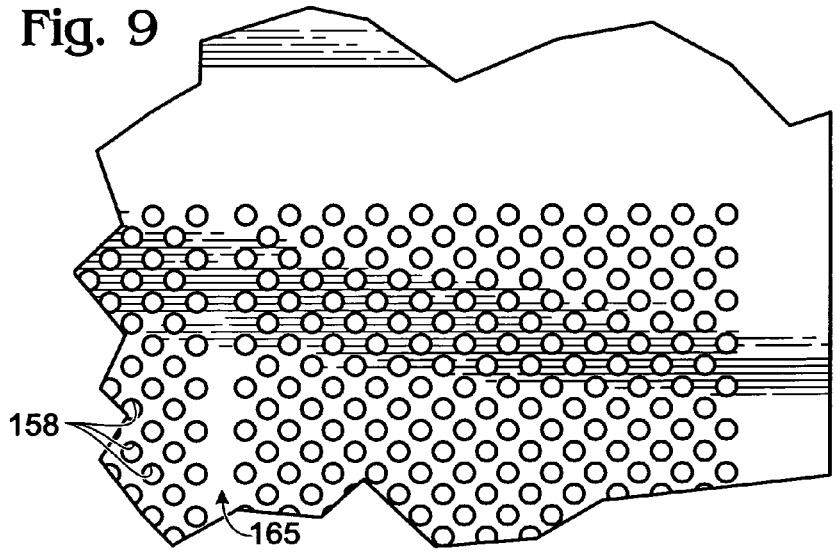
FIG. 9 is a partial view of the conveyor belt of FIG. 8.

Another example of a non-mesh conveyor belt is shown in FIGS. 8-9 and is generally indicated at 155. Non-mesh conveyor belt 155 may be made of any suitable material(s). For example, the non-mesh conveyor belt may at least substantially be made of rubber and/or rubber material(s). The non-mesh conveyor belt may include one layer (or ply) or multiple layers (or plies). Additionally, non-mesh conveyor belt 155 may include a plurality of perforations and/or holes 158. The plurality of perforations and/or holes may be configured to drain at least some fluid from at least one of the first debris stream and the second debris stream, such as toward the fluid collection structure. The holes may be any suitable size, such as 5/16 inches in diameter, and/or may be spaced any suitable distance, such as 5/16 inches.

Holes 158 may be positioned on the belt in any suitable manner. For example, the holes may be distributed across at least a substantial portion of the non-mesh conveyor belt, such as on one or more perforated portions 161 of the non-mesh conveyor belt. Alternatively, or additionally, at least some of holes 158 may be grouped in plural arrays of holes, and at least some of the array of holes may include plural rows of holes. The plural rows of holes may have regular, staggered, and/or irregular patterns. For example, the staggered plural rows of holes are shown in FIGS. 8-9. Additionally, or alternatively, at least some of the array of holes may be spaced from the other array of holes via one or more solid portions 162 of the non-mesh conveyor belt.

The non-mesh conveyor belt may include any suitable number of perforated portions and solid portions. For example, the non-mesh conveyor belt may include one or more horizontal solid portions 164, and one or more vertical portions 165, as shown in FIGS. 8-9. The perforated portions and the solid portions may have any suitable dimensions. For example, for a belt with a 36" width (measured perpendicular to the direction of travel for the belt), the perforated portions may have a width of about 7 inches (such as 7 3/16 inches), and the solid portions may have a width of about 0.5 inches (such as 5/16 inches between perforated portions) to about 3 inches (such as 3 3/16 inches at the perimeter of the belt). Additionally, or alternatively, the horizontal solid portion may have a length (measured in the direction of travel for the belt) of about 6 inches.

Although a particular arrangement for the perforated and solid portions is shown, those portions may be arranged in any suitable way(s). Additionally, although particular dimensions are given for the perforated and solid portions, those portions may have any suitable dimensions. Moreover, although holes 158 are shown to be distributed across a substantial portion of the non-mesh conveyor belt, the holes may be distributed across any suitable portion(s) of that belt. Furthermore, although holes 158 are shown to be arranged in plural staggered rows, the holes may alternatively, or additionally, be arranged in any suitable way(s), such as regular and/or irregular patterns.

First conveyor belt 46 and second conveyor belt 54 may include any of the conveyor belts discussed herein and/or any other suitable conveyor belt(s). For example, first conveyor belt 46 may include non-mesh conveyor belt 155, and second conveyor belt 54 may include non-mesh conveyor belt 55. Alternatively, first conveyor belt 46 may include a plastic mesh belt, and second conveyor belt 54 may include non-mesh conveyor belt 55.

Although first conveyor belt 46 is discussed to include non-mesh conveyor belt 155 or a plastic mesh belt, the first conveyor belt may include any suitable type of belt made of any suitable material(s), such as a wire mesh belt and/or non-mesh conveyor belt 55. Additionally, although second conveyor belt 54 is shown to include non-mesh conveyor belt 55, the second conveyor belt may be any suitable type(s) of belt and/or be made of any suitable material(s). For example, second conveyor belt 54 may alternatively be a mesh conveyor belt, and/or may be made of plastic, wire, and/or any suitable material(s). Moreover, although separating structure 14 is shown to include mixing tank 24, fluid ejection assembly 26, and conveying assembly 28, the separating structure may include any suitable components configured to separate mixed debris stream M into the plurality of debris streams.

Fluid collection structure 16 may include any suitable structure configured to collect fluid from separating structure 14. When fluid collection structure 16 collects fluid(s) that at least substantially includes water, then the fluid collection structure also may be referred to as a water collection structure. An illustrative example of fluid collection structure 16 may include a collection tank 64, which may include an interior 66, an internal wall 68, at least one first conduit 70, and at least one second conduit 72, as shown in FIG. 2. Interior 66 is sized to receive and collect fluid from separating structure 14. The internal wall may at least partially divide interior 66 of the collection tank between an upper portion 74 and a lower portion 76, as shown in FIG. 2. The upper portion and the lower portion also may be referred to as an upper tank and a lower tank, respectively. Upper portion 74 may be configured to receive fluid from separating structure 14.

Although internal wall 68 is shown to divide interior 66 of the collection tank at a particular angle, the internal wall may divide the interior of the collection tank at any suitable angle(s) and/or any suitable location(s). For example, the internal wall may be horizontal to increase a volume of the upper portion relative to the lower portion. Additionally, although fluid collection structure 16 is shown to include a single collection tank with an internal wall, the fluid collection structure may include separate or discrete tanks that may be in fluid communication with each other, such as a first tank and a second-tank.

First conduit 70 may include any suitable structure configured to fluidly connect upper portion 74 and lower portion 76. For example, the first conduit may include a drain valve 82 (such as a flapper valve and/or another suitable valve), as shown in FIGS. 2 and 4. The first conduit may be positioned at any suitable location. For example, the first conduit may be located on internal wall 68 and/or a bottom of the upper portion (or upper tank). Although first conduit 70 is shown to include drain valve 82, the first conduit may include any suitable valve and/or other structure configured to fluidly connect the upper and lower portions of collection tank 64. Additionally, although first conduit 70 is shown to be located on internal wall 68, the first conduit may be positioned at any suitable location.

Second conduit 72 may include any suitable structure configured to fluidly connect upper portion 74 and lower portion 76. For example, the second conduit may include a bypass pipe 84 and a bypass valve 86, as shown in FIGS. 1-2. The second conduit may be positioned at any suitable location. For example, the second conduit may be located external the collection tank. In some embodiments, second conduit 72 may be configured to drain one or more streams of fibrous material B from the upper portion to the lower portion of the collection tank.

Although second conduit 72 is shown to include bypass pipe 84 and bypass valve 86, the second conduit may include any suitable structure configured to fluidly connect the upper and lower portions of collection tank 64. Additionally, although second conduit 72 is shown to be located external the collection tank, the second conduit may be positioned at any suitable location. Moreover, although collection tank 64 is shown to include the first and second conduits, the collection tank may include any suitable number of conduits configured to fluidly connect the upper and lower portions of collection tank 64. For example, the collection tank may have two or more conduits located external the tank as an alternative to, or in addition to, one or more conduits located internal the tank.

Fluid collection structure 16 also may include a removal assembly 88, which may include any suitable structure configured to remove one or more materials (such as fibrous material stream(s) B, stream(s) of silt materials, stream(s) of sand materials, and/or other streams of suitable materials) from the fluid in the collection tank. For example, removal assembly 88 may include a drag member 90 (such as a drag chain) and rollers 92, as shown in FIG. 2. The rollers may move drag member 90 such that at least some of the materials may be collected and/or moved by the drag member from the fluid in the collection tank. Those materials may be discharged to through a discharge end portion 94 of collection tank 64 to one or more conveyors of conveying structure 18.

Although removal assembly 88 is shown to include drag member 90 and roller 92, the removal assembly may include any suitable structure configured to remove one or materials from the fluid in the collection tank. Additionally, although fluid collection structure 16 is shown to include collection tank 64 and removal assembly 88, the fluid collection structure may include any suitable structure configured to collect fluid from separating structure 14.

Conveying structure 18 may include any suitable structure configured to transport debris streams and/or materials from the separating structure and/or fluid collection structure to desired location(s), such as desired pile(s) and/or structure(s), and/or. For example, conveying structure 18 may include a third conveyor 96, a fourth conveyor 98, and a fifth conveyor 100. The third conveyor may be configured to transport material, such as fibrous material stream(s) B (and/or stream(s) of silt and/or sand materials) from the collection tank, from discharge end portion 94 to the desired location(s). Fourth conveyor 98 may be configured to transport material, such as the rock debris stream, from the second conveyor to the desired location(s), while fifth conveyor 100 may be configured to transport material, such as the wood debris stream, from the first conveyor to the desired location(s).

Although third conveyor 96, fourth conveyor 98, and fifth conveyor 100 are shown to have specific orientations that extend away from the vehicle frame, one or more of those conveyors may include any suitable orientations. In some embodiments, one or more of those conveyors may be selectively adjusted to the desired orientation(s). For example, one or more conveyors may be adjustable conveyors as described in U.S. patent application Ser. Nos. 10/971,355 and 11/053,729, the complete disclosures of which have been incorporated by reference for all purposes. Additionally, although conveying structure 18 is shown to include the third, fourth, and fifth conveyors, the conveying structure may include any suitable number of conveyors and/or any suitable structure configured to transport material from the separating structure and/or fluid collection structure to the desired location(s).

Material separator system 10 may include at least one power supply 102, which may include any suitable structure configured to at least partially provide power to the feed structure, separating structure, fluid collection structure, and/or conveying structure. For example, power supply 102 may include at least one diesel engine 104. Although power supply 102 is shown to include a diesel engine, the power supply may include any suitable power supply configured to at least partially provide power to the feed structure, separating structure, fluid collection structure, and/or conveying structure. For example, the power supply may alternatively, or additionally, include one or more batteries, power cells, gasoline engines, hydraulic systems. Alternatively, or additionally, the power supply may include structure to connect the material separator system to one or more power utility grids.

An illustrative example of the flow of various streams when the material separator system is in operation is shown in FIG. 7. In operation, material separator system 10 may be lowered such that collection tank 64 rests on a ground surface and/or on one or more leveling members. Fluids may be introduced to the mixing tank and/or collection tank to establish operating water levels in the upper and lower portions of the collection. At least one mixed debris stream M may be fed to the feed hopper. Those streams may be moved to the mixing tank via the feed conveyor. In the mixing tank, the mixed debris stream may be contacted with the fluid stream from the fluid ejection assembly.

The fluid stream may push or move material of lower density and/or weight towards the feed end portion of the first conveyor. Additionally, material of higher buoyancy may float and/or move upward the mixing tank to the feed end portion of the first conveyor. The material and/or fluid moved from the feed end portion towards the discharge end portion of the first conveyor may be characterized as first debris stream F or wood debris stream W. From that discharge end portion, the first debris stream may be received by the fifth conveyor, which may move first debris stream F from the discharge end portion of the first conveyor to desired location(s).

In contrast, material of higher density and/or weight (and/or lower buoyancy) may sink or fall down the mixing tank to the feed end portion of the second conveyor. The material and/or fluid moved from the feed end portion towards the discharge end portion of the second conveyor may be characterized as second debris stream S or rock debris stream R. From that discharge end portion, the second debris stream may be received by the fourth conveyor, which may move second debris stream S to desired location(s).

As the first conveyor moves material from its feed end portion towards its discharge end portion, fluid may be drained or removed from the first debris stream to the second conveyor. Fluid from the first debris stream may drain through the open structure of the mesh conveyor belt of the first conveyor. Similarly, as the second conveyor moves material from its feed end portion towards its discharge end portion, fluid (which may include fluid from the first debris stream) may be drained or removed from the second debris stream to the upper portion of the collection tank. Fluid from the second debris stream may drain through the holes of the non-mesh conveyor belt of the second conveyor.

Fluid collected in the upper portion of the collection tank may drain to the lower portion of that tank via the first and/or second conduits. Fibrous material, silt material, and/or sand material in the fluid of the upper portion may drain via the second conduit and/or the first conduit to the lower portion in one or more fibrous material streams B. The fluid may then be moved from the lower portion to the mixing tank via the pump and the pipe.

The fibrous material stream(s) B (and/or stream(s) of silt and/or sand materials) may be moved to the discharge end portion of the collection tank via the drag member and the rollers. From the discharge end portion, fibrous material streams B may be received by the third conveyor and may be moved to desired location(s). However, the steps discussed above may be performed in different sequences and/or in different combinations, not all steps being required for all embodiments of the material separator system.

Although the material separator system and features of the material separator system have been shown and described with reference to the foregoing operational principles and preferred embodiments, those skilled in the art will find apparent that various changes in form and detail may be made without departing from the spirit and scope of the claims. The present disclosure is intended to embrace all such alternatives, modifications, and variances that fall within the scope of the appended claims.

What is claimed is:

1. A vehicle for separating a mixed debris stream, comprising:

an elongate vehicle frame;

a separating structure mounted on the vehicle frame and configured to contact the mixed debris stream with a fluid stream at a contact region to separate the mixed debris stream into at least a first debris stream and a second debris stream, the separating structure including a mixing area and a fluid ejection assembly, the fluid ejection assembly including a fluid pipe having an end portion adjacent the mixing area and a fluid channeler pivotably connected to the end portion of the fluid pipe, wherein the second debris stream includes at least some material of a higher density than material from the first debris stream;

a first conveyor having a feed end portion positioned to receive the first debris stream from the separating structure, and a discharge end portion spaced from the feed end portion of the first conveyor; and a second conveyor having a feed end portion positioned to receive the second debris stream from the separating structure, and a discharge end portion spaced from the feed end portion of the second conveyor, wherein the contact region is spaced from the feed end portion of the first conveyor, and wherein the fluid channeler is configured to be selectively pivoted relative to the end portion of the fluid pipe to move the contact region among a plurality of locations relative to the feed end portion of the first conveyor.

2. The vehicle of claim 1, wherein the plurality of locations includes a first location adjacent the feed end portion of the first conveyor, and a second location spaced from the feed end portion of the first conveyor relative to the first location.

3. The vehicle of claim 2, wherein a location for the contact region is selected from the plurality of locations based, at least in part, on a difference between an average density of material intended to be part of the first debris stream and an average density of material intended to part of the second debris stream.

4. The vehicle of claim 1, further comprising a fluid collection structure configured to receive fluid from at least one of the separating structure, the first conveyor, and the second conveyor.

5. The vehicle of claim 4, wherein the fluid collection structure includes an upper tank, a lower tank, and an internal wall between the upper and lower tanks, the upper and lower tanks being fluidly connected via at least one conduit on the internal wall and via at least one conduit spaced from the internal wall, wherein at least the feed end portions of the first and second conveyors are disposed within the upper tank.

6. The vehicle of claim 1, wherein at least one of the first conveyor and the second conveyor includes a non-mesh conveyor belt configured to drain at least some fluid from at least one of the first debris stream and the second debris stream.

7. The vehicle of claim 6, wherein the non-mesh conveyor belt includes a plurality of holes configured to drain at least some fluid from at least one of the first debris stream and the second debris stream.

8. The vehicle of claim 7, wherein the plurality of holes of the non-mesh conveyor belt includes plural arrays of holes, and each array of holes includes plural staggered rows of holes.

9. A vehicle for separating a mixed debris stream, comprising:

an elongate vehicle frame;

a separating structure mounted on the vehicle frame and configured to contact the mixed debris stream with a fluid stream to separate the mixed debris stream into at least a first debris stream and a second debris stream, the second debris stream including at least some material of a higher density than material from the first debris stream, wherein the separating structure includes a mixing area and a fluid ejection assembly, the fluid ejection assembly being configured to selectively direct the fluid stream entering the mixing area among a plurality of ejection angles relative a horizontal plane, the fluid ejection assembly including a fluid pipe having an end portion adjacent the mixing area and a fluid channeler configured to selectively direct the fluid stream among the plurality of ejection angles, wherein the fluid channeler includes a flag pivotably connected to the end portion of the fluid pipe and configured to be selectively pivoted relative to the end portion to selectively direct the fluid stream among the plurality of ejection angles;

a first conveyor having a feed end portion positioned to receive the first debris stream from the separating structure, and a discharge end portion spaced from the feed end portion; and a second conveyor having a feed end portion positioned to receive the second debris stream from the separating structure, and a discharge end portion spaced from the feed end portion.

10. The vehicle of claim 9, wherein the ejection angle is selected from the plurality of ejection angles based, at least in part, on a difference between an average density of material intended to be part of the first debris stream and an average density of material intended to be part of the second debris stream.

11. The vehicle of claim 9, further comprising a fluid collection structure configured to receive fluid from at least one of the separating structure, the first conveyor, and the second conveyor, the fluid collection structure including an upper tank, a lower tank, and an internal wall between the upper and lower tanks, the upper and lower tanks being fluidly connected via at least one conduit on the internal wall and via at least one conduit disposed external the upper and lower tanks, and wherein at least the feed end portions of the first and second conveyors are disposed within the upper tank.

12. The vehicle of claim 9, wherein at least one of the first conveyor and the second conveyor includes a non-mesh conveyor belt configured to drain at least some fluid from at least one of the first debris stream and the second debris stream, and wherein the non-mesh conveyor belt includes a plurality of holes configured to drain at least some fluid from at least one of the first debris stream and the second debris stream.

13. The vehicle of claim 12, wherein the plurality of holes of the non-mesh conveyor belt includes plural arrays of holes, and each array of holes includes plural staggered rows of holes.

14. A vehicle for separating a mixed debris stream that includes wood pieces and rock, comprising:

an elongate vehicle frame;

a separating structure mounted on the vehicle frame and configured to contact the mixed debris stream with a water stream at a contact region to separate the mixed debris stream into a wood debris stream that includes at least some water from the water stream and at least a substantial portion of the wood pieces from the mixed debris stream, and a rock debris stream that includes at least some water from the water stream and at least a substantial portion of the rock from the mixed debris stream, the separating structure including a mixing area and a fluid ejection assembly, the fluid ejection assembly including a fluid pipe having an end portion adjacent the mixing area and a fluid channeler pivotably connected to the end portion of the fluid pipe;

a wood conveyor having a feed end portion positioned to received the wood debris stream from the separating structure, and a discharge end portion spaced from the feed end portion of the wood conveyor;

a rock conveyor having a feed end portion positioned to receive the rock debris stream from the separating structure, and a discharge end portion spaced from the feed end portion of the rock conveyor; and a water collection structure configured to receive water from the separating structure, the wood conveyor, and the rock conveyor, wherein the contact region is spaced from the feed end portion of the wood conveyor, and wherein the fluid channeler is to be selectively pivoted relative to the end portion to move the contact region among a plurality of locations relative to the feed end portion of the wood conveyor.

15. The vehicle of claim 14, wherein the water collection structure includes an upper tank, a lower tank, and an internal wall between the upper and lower tanks, the upper and lower tanks being fluidly connected via at least one conduit on the internal wall and via at least one conduit disposed external the upper and lower tanks, wherein at least the feed end portions of the first and second conveyors are disposed within the upper tank.

16. The vehicle of claim 14, wherein at least one of the wood conveyor and the rock conveyor includes a non-mesh conveyor belt configured to drain at least some fluid from at least one of the first debris stream and the second debris stream, and wherein the non-mesh conveyor belt includes a plurality of holes configured to drain at least some fluid from at least one of the first debris stream and the second debris stream.

17. The vehicle of claim 16, wherein the plurality of holes of the non-mesh conveyor belt includes plural arrays of holes, and each array of holes includes plural staggered rows of holes.

18. The vehicle of claim 17, wherein the non-mesh conveyor belt includes elongate cleats configured to prevent material from at least one of the wood debris stream and the rock debris stream from moving toward the feed end portion of at least one of the wood conveyor and the rock conveyor, and wherein the elongate cleats are disposed between the plural staggered rows of holes.

* * * * *